United States Patent [19]

Gardner

[11] 4,397,271

[45] Aug. 9, 1983

[54] SEMI-SELF-CONTAINED HYDRAULIC LASH ADJUSTER

[75] Inventor: William J. Gardner, Wheaton, Ill.

[73] Assignee: Stanadyne, Inc., Windsor, Conn.

[21] Appl. No.: 239,334

[22] Filed: Mar. 2, 1981

[51] Int. Cl.[3] ..... F01L 1/24

[52] U.S. Cl. ..... 123/90.55; 123/90.58

[58] Field of Search ..... 123/90.43, 90.46, 90.55, 123/90.56, 90.57, 90.58, 90.59

[56] References Cited

U.S. PATENT DOCUMENTS

| | | | |
|---|---|---|---|
| 2,109,815 | 3/1938 | Best | 123/90.59 |
| 2,213,195 | 9/1940 | Banker | 123/90.59 |
| 2,752,903 | 7/1956 | Banker | 123/90.59 |
| 2,908,260 | 10/1959 | Bergmann | 123/90.57 |
| 3,476,093 | 11/1969 | Line | 123/90.55 |
| 3,495,577 | 2/1970 | Collins | 123/90.58 |

FOREIGN PATENT DOCUMENTS

| | | | |
|---|---|---|---|
| 1808000 | 5/1970 | Fed. Rep. of Germany | 123/90.55 |

*Primary Examiner*—Craig R. Feinberg
*Assistant Examiner*—W. R. Wolfe
*Attorney, Agent, or Firm*—Kinzer, Plyer, Dorn & McEachran

[57] ABSTRACT

A semi-self-contained hydraulic lash adjuster includes a generally cylindrical cup-shaped follower which will be positioned with the open side down, defining a chamber within the follower. A body is positioned axially within the chamber and is supported by a spacer whose periphery is attached to the follower. A plunger is reciprocally movable within the body and a high pressure chamber is defined between the plunger and body. A check valve in the plunger controls fluid access into the high pressure chamber. A diaphragm-type seal is peripherally attached to the body and is in sealing engagement with an internal surface of the follower. Fluid is positioned within the reservoir defined by the seal, which fluid is in communication with the high pressure chamber through the check valve.

6 Claims, 3 Drawing Figures

SEMI-SELF-CONTAINED HYDRAULIC LASH ADJUSTER

SUMMARY OF THE INVENTION

The present invention relates to hydraulic lash adjusters and in particular to a semi-self-contained hydraulic lash adjuster.

A primary purpose of the invention is a hydraulic lash adjuster of the type described utilizing a peripheral seal positioned between the follower and the body to define a reservoir which is in controlled communication with the lash adjuster high pressure chamber.

Another purpose is a lash adjuster of the type described in which the diaphragm-type seal is attached to the body and in sealing engagement with an internal surface of the follower.

Another purpose is a lash adjuster of the type described in which the outer periphery of the diaphragm seal is in sliding engagement with the lash adjuster follower.

Another purpose is a hydraulic lash adjuster of the type described which keeps aerated oil from the high compression chamber through the use of a specific seal construction.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to a semi-self-contained hydraulic lash adjuster or tappet usable with overhead cam engines in which there is a reservoir of hydraulic fluid in communication with the tappet high pressure chamber. The introduction of aerated oil or oil with entrained air into a tappet is not uncommon and this problem is particularly severe in an inverted type of tappet such as disclosed in the present application. A diaphragm seal is positioned within the tappet to prevent aerated oil from reaching the high compression chamber. It has long been known in the art that if aerated oil or oil with entrained air reaches the high compression chamber the tappet becomes noisy, a very objectionable operating condition. In the present invention there is a self-contained reservoir of oil which is defined in part by a peripheral seal and this seal separates the oil provided to the high pressure chamber from any possible air which might be entrained or included with oil normally supplied from the engine oil galley.

Figure 1:
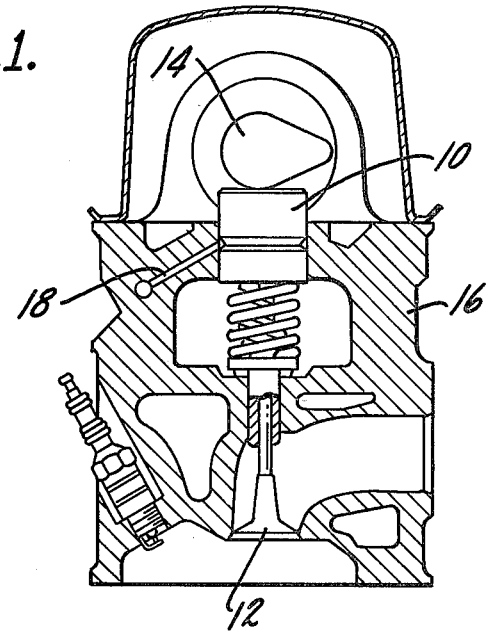
FIG. 1 is a diagrammatic illustration of a lash adjuster of the type described as positioned within an internal combustion engine.

In FIG. 1, a lash adjuster 10 is positioned axially above a valve 12 and in turn immediately below an overhead cam 14. The lash adjuster of the present invention is specifically directed for use in small efficient internal combustion engines utilizing overhead cams. The engine cylinder casting is indicated at 16 and may have a conventional oil galley and a channel 18 which is in communication with an exterior groove on lash adjuster 10.

Figure 2:
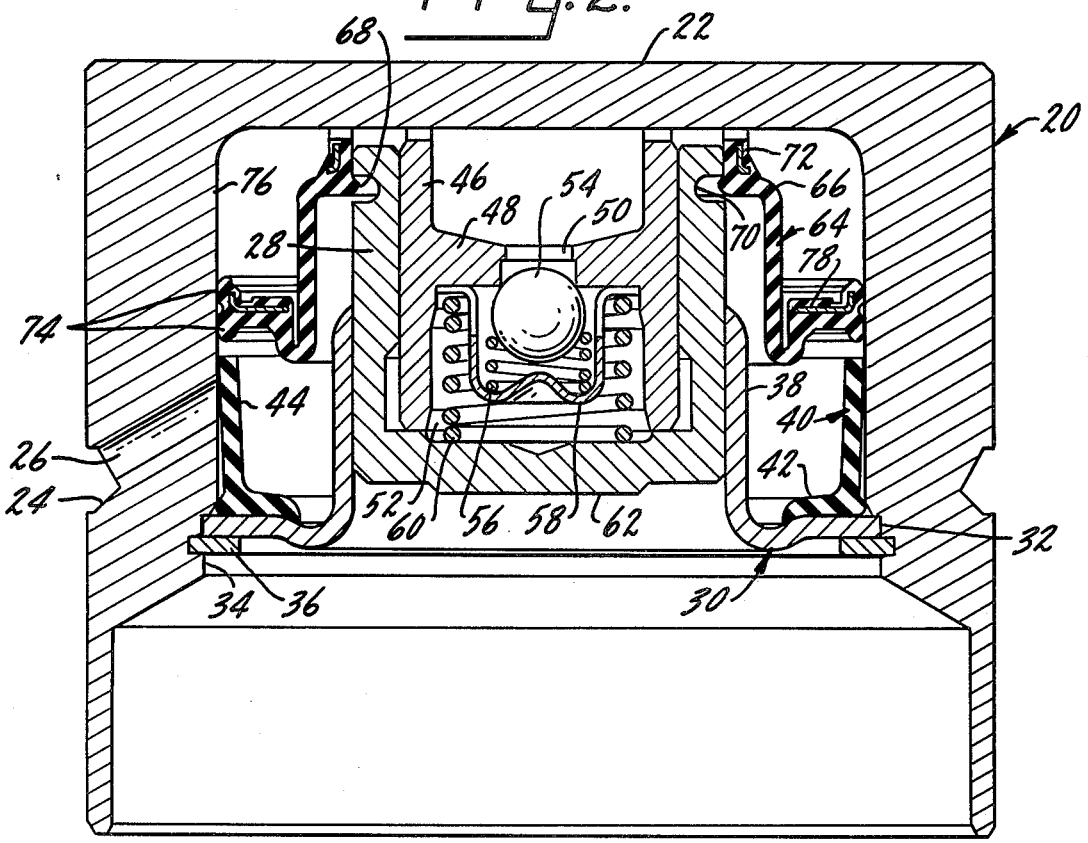
FIG. 2 is a cross-sectional view of the lash adjuster of FIG. 1.

Details of the lash adjuster are illustrated in FIG. 2. An inverted cup-shaped follower 20 has an upper surface 22 which will be in contact with the overhead cam 14. The follower 20 has an open interior to receive the upper end of valve 12 as is conventional in lash adjuster-/engine constructions of the type described. The follower has an external groove 24 and a small passage 26 in communication therewith. Passage 26 opens into the chamber defined by the follower.

Axially positioned within follower 20 is a body 28. A spacer 30 has an outer peripheral edge 32 which extends within a groove 34 in the internal surface of the follower with the spacer being held in that position by a snap ring 36 positioned directly beneath it. The interior surface of the upwardly-extending central portion 38 of the spacer provides a close but noninterfering fit with the exterior surface of body 28, thereby radially positioning the body within the follower. The body is free to move upwardly to the extent permitted by the axial dimensions of the plunger to be described hereinafter, with the downward restriction on the body being defined by a diaphragm seal also to be described hereinafter.

Spacer 30 will support an annular seal member 40 which has a lower annular surface 42 resting upon the spacer and an upwardly-extending cylindrical portion 44 which will yieldingly close passage 26. Oil pressure in passage 26 will cause member 44, in the area of the passage, to move slightly away from the passage permitting limited access into the chamber defined by follower 20. Details of seal member 40 and a more specific description of its function are disclosed in copending application Ser. No. 219,266, filed Dec. 22, 1980, and assigned to the assignee of the present application.

Reciprocally mounted within body 28 is a plunger 46 with the plunger having an interior wall 48 with a passage 50 which permits fluid to flow from the area above the wall into a high pressure chamber 52 which is defined between the body and the plunger. Access through passage 50 is controlled by a check valve consisting of a ball member 54 biased against the lower edge of the passage by a small coil spring 56. Spring 56 in turn is retained by a retainer member 58. A check valve is conventional in tappets of the type described. Movement of the plunger relative to the body is controlled by a coil spring 60 bottomed upon the body and normally biasing the body outwardly from the plunger. Spring 60 is positioned within the described high pressure chamber 52.

The lower surface of body 28 may have a circular boss 62 which normally will be in contact with the upper end of valve member 12, a conventional construction for lash adjusters usable in overhead cam-type engines.

A contained fluid reservoir providing hydraulic fluid for the high pressure chamber 52 is defined by a diaphragm-type seal member 64. The seal member has an inner peripheral portion 66 including a projection 68 which extends within an annular groove 70 on the exterior of body 28. Thus, by means of the groove and projection, the diaphragm seal is attached to the body. A reinforcing member 72 may be embedded within the diaphragm seal which may itself be formed of rubber or any one of a number of similar elastomeric materials.

The exterior peripheral area of seal member 64 may include a pair of slightly spaced annular beads 74 which bear against an internal surface 76 of follower 20. The periphery of the diaphragm seal is not fixed to the follower, but rather is firmly in sealing engagement due to the inherent elasticity and yielding qualities of the seal. The seal periphery can, however, move slidingly relative to the follower internal surface. A second reinforcement 78 may similarly be embedded within the rubber or elastomeric material forming the diaphragm seal.

Installation of the seal member is important in terms of assembly of the lash adjuster. The first step in installation is to take an empty follower and add whatever hydraulic fluid or oil to be placed in the reservoir in communication with the high pressure chamber. The seal is then positioned centrally within the follower after which the body is inserted centrally of the seal. As the body is pushed in, projection 68 will snap into groove 70 thus attaching the seal to the body. Normally, the combination of the body and plunger will be an assembly completed prior to installation of the body within the follower. After the body has been pushed in to the point where the projection fits within groove 70, the force of spring 60 will normally urge the body outwardly a slight amount, which action will cause the outer periphery of the seal or the parallel beads 74 to move to the furthest inward position within the follower. The final or operating position of the lash adjuster, as shown in FIG. 2, will permit sliding movement of the outer periphery of the diaphragm seal along a limited portion of the internal surface of the follower, as operating conditions and the amount of hydraulic fluid in the reservoir dictate.

Normally, there will be sufficient fluid within the reservoir defined by diaphragm seal 64 to provide for operation of the lash adjuster. Diaphragm seals are made to last over an extended period of time. However, under some conditions it is not impossible that the diaphragm seal may in fact rupture. For this reason it is desirable to include a conventional means for supplying hydraulic fluid. Thus, oil from the engine galley may flow in passage 26, causing movement of seal portion 44 away from the normal sealing position against the passage to providing hydraulic or oil pressure for lash adjuster operation. If under such circumstances there were to be air entrained with the oil or aerated oil provided to the tappet high pressure chamber, the tappet would be noisy, but it would still remain operable.

Figure 3:
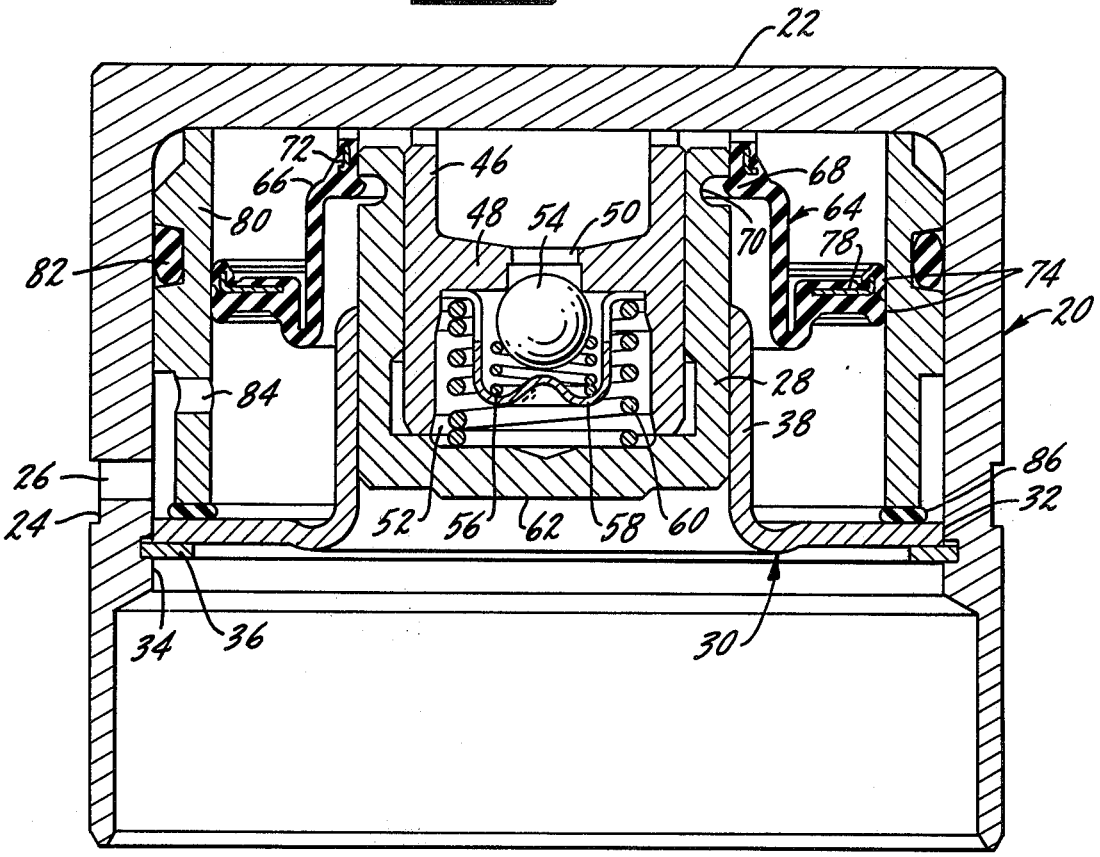
FIG. 3 is an enlarged axial section, similar to FIG. 2, illustrating a modified form of lash adjuster construction.

The construction of FIG. 3 is substantially the same as that of FIG. 2 and like parts have been given the same number. In the FIG. 3 construction the seal 40 has been eliminated but it could be included if desired. A sleeve 80 is positioned on the inside of follower 20 and forms the internal bearing surface for diaphragm seal 64. It is at times difficult to machine a smooth internal surface for follower 20 and, thus, in order to provide the type of surface necessary for the small degree of movement required by seal 64 it is desirable to utilize a sleeve, having a smooth internal surface, on the inside of the follower. It is basically a case of the difficulties and expense involved in machining an internal surface such as that on the inside of the follower. Sleeve 80 is fixed in position and may itself have a seal ring 82 which bears against the internal surface of the follower 20. A port 84 is in communication with follower port 26 so that engine galley oil may reach the inside of the follower. The lower end or bottom of sleeve 80 may seat upon a seal 86 positioned on spacer 30. In other respects the construction of FIG. 3 is the same as that of FIG. 2.

Although the lash adjuster has been described as including seal 40, the structure is operable without this element.

The diaphragm seal is particularly advantageous, not only because of its ease of assembly, but also because of the unique way in which it is positioned within the follower.

Whereas the preferred form of the invention has been shown and described herein, it should be realized that there may be many modifications, substitutions and alterations thereto.

The embodiments of the invention in which an exclusive property or privilege is claimed are defined as follows:

1. A semi-self-contained lash adjuster including a generally cylindrical cup-shaped follower defining a chamber, a body positioned axially in said chamber and a spacer supporting said body, a plunger reciprocally movable within said body and a high pressure chamber defined between said plunger and body, a check valve in said plunger controlling fluid access into said high pressure chamber, the improvement comprising a diaphragm-type seal peripherally attached to and movable with said body and in sealing sliding engagement with an internal surface of said follower, said seal defining a reservoir in communication with said high pressure chamber through said check valve.

2. The lash adjuster of claim 1 further characterized in that said body has a peripheral groove, with a projection on said seal extending into said groove to attach said seal to said body.

3. The lash adjuster of claim 1 further characterized by and including a passage in said follower from the exterior thereof opening into said chamber, and a flexible seal member permitting controlled fluid flow through said passage into said chamber.

4. The lash adjuster of claim 1 further characterized in that said seal is in sliding engagement with said follower.

5. The lash adjuster of claim 1 further characterized by including a sleeve positioned within said follower, said diaphragm seal being in sealing engagement with said sleeve.

6. The lash adjuster of claim 5 further characterized by and including an oil port in said sleeve, and an oil passage in said follower in communication therewith.

* * * * *